US005930957A

United States Patent [19]

Bernardi

[11] Patent Number: 5,930,957

[45] Date of Patent: Aug. 3, 1999

[54] SYSTEM ROOF

[76] Inventor: Joseph Bernardi, Buttinghstraat 24, Hoensbroek 6431 JE, Netherlands

[21] Appl. No.: 08/860,407

[22] PCT Filed: Dec. 18, 1995

[86] PCT No.: PCT/NL95/00425

§ 371 Date: Sep. 26, 1997

§ 102(e) Date: Sep. 26, 1997

[87] PCT Pub. No.: WO96/20318

PCT Pub. Date: Jul. 4, 1996

[30] Foreign Application Priority Data

Dec. 28, 1994 [NL] Netherlands ..... 9402229

[51] Int. Cl.[6] ..... E04B 7/04

[52] U.S. Cl. ..... 52/92.1; 52/92.2; 52/93.2; 52/92.3; 52/22

[58] Field of Search ..... 52/93.2, 92.2, 52/90.1, 90.2, 92.1, 92.3, 22

[56] References Cited

U.S. PATENT DOCUMENTS

| | | | |
|---|---|---|---|
| 1,988,388 | 1/1935 | Mioton . | |
| 2,764,107 | 9/1956 | Niswonger et al. . | |
| 2,765,498 | 10/1956 | Kelnhofer . | |
| 3,333,875 | 8/1967 | Tracy . | |
| 3,376,676 | 4/1968 | Tatevossian | 52/93.2 |
| 3,950,903 | 4/1976 | Lerch et al. . | |
| 4,294,051 | 10/1981 | Hughes, Jr. | 52/98 |
| 4,455,792 | 6/1984 | Pasco | 52/93.2 |
| 4,707,960 | 11/1987 | Bullock | 52/404 |
| 4,809,468 | 3/1989 | Bareiss | 52/22 |
| 4,878,323 | 11/1989 | Nelson | 52/92 |
| 4,932,173 | 6/1990 | Commins | 52/92 |
| 5,481,844 | 1/1996 | Kajita | 52/702 |
| 5,660,005 | 8/1997 | Tacoma | 52/93.2 |

FOREIGN PATENT DOCUMENTS

| | | |
|---|---|---|
| 0006257 | 1/1980 | European Pat. Off. . |
| 3330992 | 3/1985 | Germany . |
| 552283 | 3/1943 | United Kingdom . |

*Primary Examiner*—Carl D. Friedman
*Assistant Examiner*—Yvonne Horton-Richardson
*Attorney, Agent, or Firm*—Webb Ziesenheim Logsdon Orkin & Hanson, P.C.

[57] ABSTRACT

A system roof for prefabricated building construction has a pair of rafter beams, which are provided at end parts with couplings. The opposite end parts have vertically directed posts for connection to a gable wall. The pairs of rafter beams are connected to each other by means of running joists. Such a system roof can be used for construction of a building or for interchange with an existing roof.

7 Claims, 2 Drawing Sheets

SYSTEM ROOF

The invention relates to a system roof.

BACKGROUND OF THE INVENTION

Field of the Invention

Known from EP-A-0 006 257 is a skeleton structure for a prefabricated building construction. Used as roof in such a skeleton structure are rafters which are disposed in pairs and of which the mutually facing end parts are joined to each other by a connecting construction. In addition the rafters of a pair are mutually joined by a horizontal joist in order to obtain the required stiffness. From DE-A-33 30 992 a structure as described in the preamble of claim 1 is known.

From GB-A-552,283 a roof system is known in which end parts of rafter beams are hingedly connected to substantially horizontal channel plates. Such a roof system lacks the necessary stiffness.

The invention has for its object to improve the known roof construction.

SUMMARY OF THE INVENTION

Rapid erection becomes possible with such a roof construction, while a material saving is further achieved relative to the known roof construction. The horizontal joist between the rafter beams forming a pair is omitted in the roof construction according to the present invention. In addition, it is possible with the present roof construction according to the invention to erect an attic story since it is possible to opt for a greater distance between the attic floor and the rafter beams. The attic floor serves herein as horizontally directed connection between the rafter beams of a pair. The posts can have a desired length with which the height of the attic story can then be determined.

The connection between the post and a gable wall can be formed by a U-shape directed toward the gable wall. The gable wall can be erected further than the attic floor, which is another option for setting the height of the attic story.

The coupling means preferably consist of a standing plate welded to each rafter beam and a nut-bolt connection joining together the adjoining plates. For further stiffening of the roof construction a second vertical post can be arranged on a rafter beam at a distance from the first post, which second post then rests on the attic floor.

For the end gable use can be made of a hip rafter pair, wherein mutually facing end parts of the pair then have vertically directed plates which are provided with nut-bolt connections. At such a roof point a connection can be effected between a rafter beam pair and a hip rafter pair by means of coupling the welded-on vertical plates.

The invention will be elucidated with reference to an embodiment.

DESCRIPTION OF THE PREFERRED EMBODIMENTS

Figure 1:
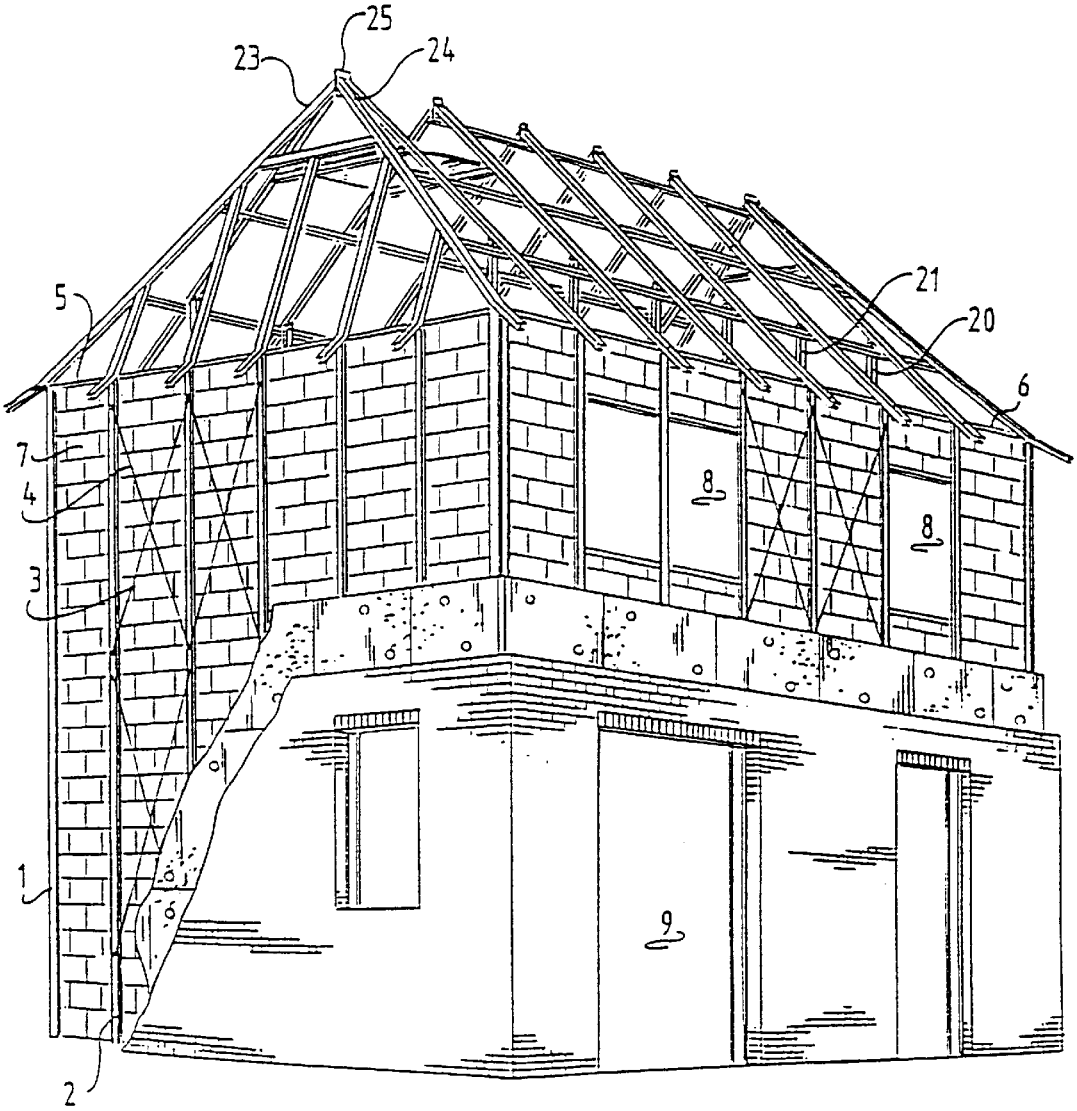
FIG. 1 shows a perspective view of a multi-story dwelling with a roof construction according to the invention.
Figure 2:
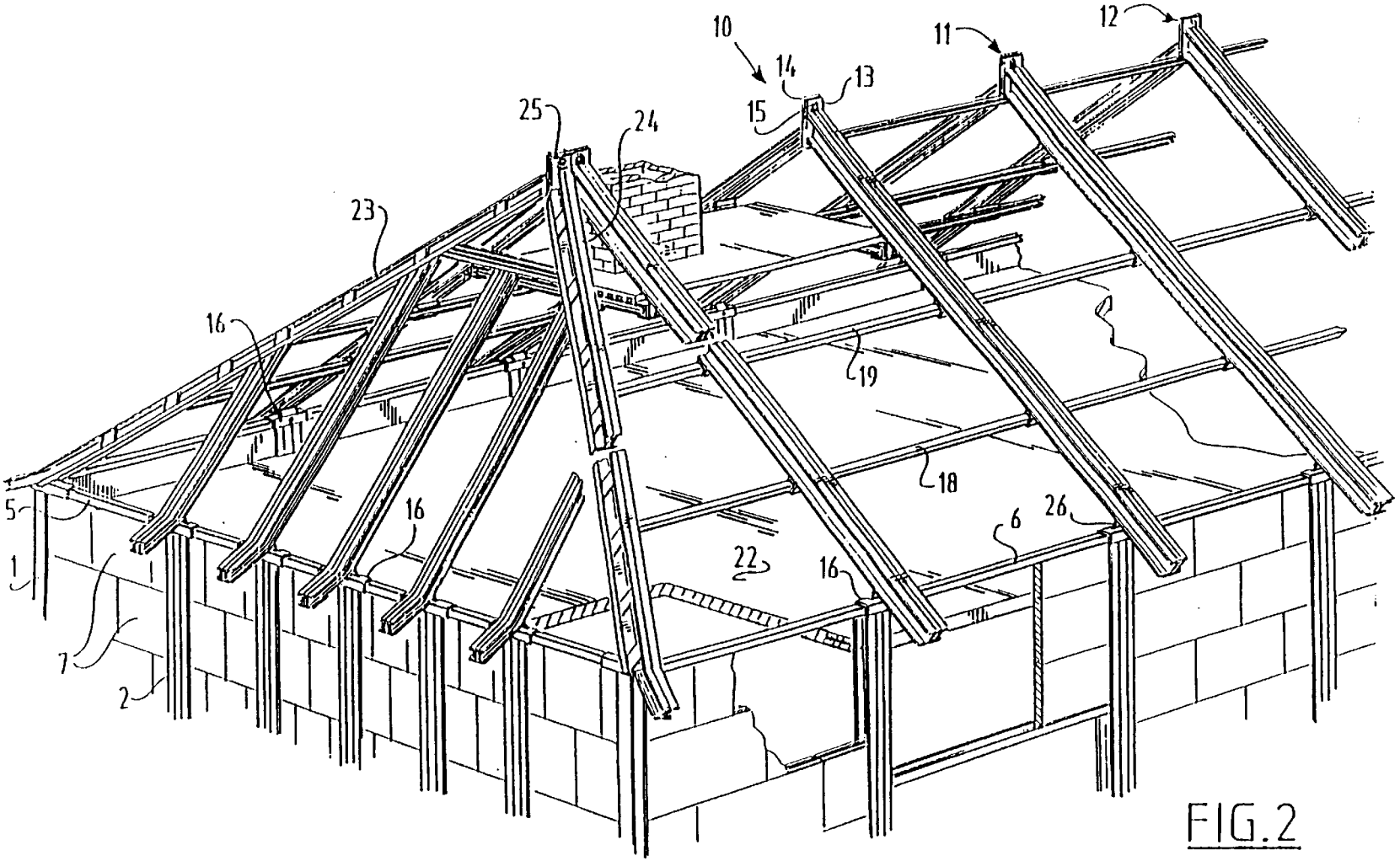
FIG. 2 shows in perspective view a detail of the roof construction of the embodiment of FIG. 1.

The multi-story dwelling comprises vertical steel posts, for instance 1, 2 which are mutually braced by means of struts, for instance 3, 4. The top ends of the posts are mutually joined by horizontal joists 5, 6. The intermediate spaces between the posts are walled up with bricks or blocks 7 or contain windows 8 or door openings 9. According to the invention a roof construction consists of pairs 10, 11, 12 of rafters. The mutually facing end parts of each pair are provided with vertically oriented, upright, welded-on plates 13, 14 which are mutually coupled by a nut-bolt connection 15. On the end parts each rafter beam has a vertically oriented post having a U-shaped end part 16 which engages around the horizontal joist, for instance 6, and is anchored thereto in this manner. The pairs are mutually joined by horizontal joists, for instance 18, 19. According to a preferred embodiment further vertical posts 20, 21 can also be present which support on the attic floor 22.

In order to obtain an end gable a hip rafter pair 23, 24 can likewise be used which are also coupled to each other and to an adjoining rafter pair by means of vertically welded plates 25.

The roof construction according to the invention can be used as prefab roof. The roof construction can be arranged rapidly and simply. It is also possible to arrange the roof construction on existing dwellings. In the case of roof repair the whole existing roof can for instance be removed and replaced by the prefabricated system roof according to the invention.

I claim:

1. A building provided with a system roof and gable walls, wherein said system roof is comprised of pairs of rafter beams abutting one another at mutually facing end parts, wherein the rafter beams of each pair are disposed sloping in opposing directions, the mutually facing end parts of said beams are provided with coupling means and the other end parts of said beams have substantially upright directed posts with means for connecting to a gable wall having horizontal gable joists thereupon, and further comprised of substantially horizontal running joists mutually connecting the pairs of rafter beams, wherein there are means for connecting to a gable wall, which is comprised of an inverted U-shaped part at the end of each upright directed post and the U-shaped part engages around one of the horizontal gable joists and wherein said roof system further includes a floor tied to the horizontal gable joists thereby providing horizontal support to the pairs of rafter beams.

2. The building as claimed in claim 1, wherein the coupling means consist of two standing plates, one welded onto each of a pair of rafter beams, and a nut-bolt connection joining the plates to each other.

3. The building as claimed in claim 1, wherein a second vertical post is arranged at a distance from the first post.

4. The building as claimed in claim 1, further including a hip rafter pair, wherein the mutually facing end parts of the pair have vertically directed plates which are provided with nut-bolt connections.

5. The building as claimed in claim 2, wherein a second vertical post is arranged at a distance from the first post.

6. The building as claimed in claim 2, further including a hip rafter pair, wherein the mutually facing end parts of the pair have vertically directed plates which are provided with nut-bolt connections.

7. The building as claimed in claim 3, further including a hip rafter pair, wherein the mutually facing end parts of the pair have vertically directed plates which are provided with nut-bolt connections.

* * * * *